US009885353B2

(12) United States Patent
Tetzlaff et al.

(10) Patent No.: US 9,885,353 B2
(45) Date of Patent: Feb. 6, 2018

(54) PRESSURE RELIEF MECHANISM FOR LINEAR ACTUATOR WELL PUMP

(71) Applicant: Baker Hughes Incorporated, Houston, TX (US)

(72) Inventors: Steven K. Tetzlaff, Owasso, OK (US); Lance T. Robinson, Tulsa, OK (US); Gary L. James, Claremore, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 324 days.

(21) Appl. No.: 14/793,015

(22) Filed: Jul. 7, 2015

(65) Prior Publication Data

US 2016/0010640 A1 Jan. 14, 2016

Related U.S. Application Data

(60) Provisional application No. 62/021,889, filed on Jul. 8, 2014.

(51) Int. Cl.

| | |
|---|---|
| ***F04B 47/06*** | (2006.01) |
| ***F04B 53/12*** | (2006.01) |
| ***F04B 17/03*** | (2006.01) |
| ***F04B 53/14*** | (2006.01) |
| ***E21B 43/12*** | (2006.01) |

(52) U.S. Cl.

CPC ..... *F04B 53/125* (2013.01); *E21B 43/127* (2013.01); *E21B 43/128* (2013.01); *F04B 17/03* (2013.01); *F04B 47/06* (2013.01); *F04B 53/14* (2013.01)

(58) Field of Classification Search

CPC ..... F04B 47/02; F04B 47/022; F04B 47/026; F04B 47/06; E21B 43/127; E21B 43/128; E21B 53/125

See application file for complete search history.

(56) References Cited

U.S. PATENT DOCUMENTS

| | | | | |
|---|---|---|---|---|
| 2,669,939 A * | 2/1954 | Vickers | F04B 47/00 417/448 |
| 3,040,673 A * | 6/1962 | Dunbar | F04B 47/04 166/243 |
| 6,155,792 A | 12/2000 | Hartley et al. | |

OTHER PUBLICATIONS

U.S. Appl. No. 14/579,585, filed Dec. 22, 2014 entitled. "Downhole Motor Driven Reciprocating Well Pump".

U.S. Appl. No. 14/599,002, filed Jan. 16, 2015 entitled: "Magnetic Anti-Gas Lock Rod Pump".

* cited by examiner

*Primary Examiner* — Patrick Hamo

(74) *Attorney, Agent, or Firm* — Bracewell LLP; James E. Bradley

(57) ABSTRACT

A reciprocating well pump assembly has a barrel and a piston reciprocally carried within the barrel between up stroke and down stroke positions. A travelling valve moves with the piston and has a closed position during the up stroke an open position during the down stroke. A relief port extends from a bore of the piston below the travelling valve into the barrel. A valve sleeve mounted around the body of the travelling valve is axially movable between a closed position, closing the tubular body relief port, and an open position, communicating well fluid in the barrel with the well fluid in the bore of the piston. When nearing the top of the stroke, the valve sleeve abuts a stop in the barrel. Continued upward movement of the piston causes the valve sleeve to open the relief port.

20 Claims, 5 Drawing Sheets

PRESSURE RELIEF MECHANISM FOR LINEAR ACTUATOR WELL PUMP

CROSS REFERENCE TO RELATED APPLICATION

This application claims priority to provisional application 62/021,889, filed Jul. 8, 2014.

FIELD OF THE DISCLOSURE

This disclosure relates in general to linear actuator driven reciprocating well pumps and in particular to a mechanism that relieves pressure while the piston is transitioning between completion of the up stroke and beginning of the down stroke.

BACKGROUND

A reciprocating well pump normally has a barrel secured to a string of production tubing. A piston located in the barrel strokes between a down stroke and an up stroke. A travelling valve mounted with the piston opens a bore of the piston during the down stroke to flow well fluid in the bore of the piston into the barrel above the piston. During the up stroke, the travelling valve closes to lift the well fluid from the barrel upward. A standing valve at an upper end of the barrel will be closed during the down stroke and opens on the op stroke to allow the well fluid being lifted to low up into the production tubing.

A string of rods may extend down the tubing for stroking the piston. Other types of stroking devices are known. For example, an electric motor may be installed below the barrel. A linear actuator coupled between the motor and the piston converts rotary motion of an output shaft of the motor into linear motion of the piston. The linear actuator may include a rotatable shaft with helical grooves engaged by a ball nut that is restrained from rotating. The rotation of the linear actuator shaft causes the ball nut to move up one set of helical grooves until reaching a crossover at the top of the linear actuator shaft, then move down a second set of helical grooves. A linking member connects the ball nut with the piston to move the piston in unison. The linear actuator shaft rotates in only one direction.

A dwell time occurs at or near the top of the stroke while the ball nut moves from one set of helical grooves to the other. During this dwell time, the standing valve will be open, communicating the weight of the column of well fluid in the production tubing with the well fluid in the barrel. Normally, the standing valve element is a ball that drops onto a seat due to gravity when the well fluid being pushed up by the piston stops flowing. In some instances, the well fluid pressure in the barrel is high enough to keep the standing valve element from closing, creating a stalled condition.

SUMMARY

A reciprocating well pump assembly has a barrel and a piston sub assembly reciprocally and slidably carried within the barrel between up stroke and down stroke positions. The piston sub assembly has a bore for receiving well fluid from the well during the down stroke. A travelling valve element in the piston sub assembly moves between an open position allowing the well fluid to flow up the bore into the barrel above the piston sub assembly during the down stroke to a closed position during the up stroke for lifting the well fluid located in the barrel above the piston sub assembly. A standing valve at an upper end of the barrel is movable between an open position during the up stroke of the piston sub assembly and a closed position during the down stroke of the piston sub assembly. A relief port extends from the bore of the piston sub assembly into the barrel. A relief port valve closes the relief port during the down stroke and part of the upstroke. The relief port valve opens the relief port as the piston sub assembly nears a top of the stroke to reduce fluid pressure in the barrel above the piston sub assembly and allow the standing valve to move to the closed position at the top of the stroke.

Preferably, the relief port extends from the bore to an annulus located between the piston sub assembly and the barrel. More specifically, the piston sub assembly has a piston that slidably engages the bore. The relief port extends from the bore to an annulus in the barrel surrounding the travelling valve element above the piston.

A stop is located in the barrel below the standing valve. The relief port valve engages the stop as the piston sub assembly nears the top of the stroke to cause the relief port to open. The relief port valve moves in unison with the piston sub assembly during the up stroke until reaching the stop. Continued upward movement of the piston sub assembly relative to the relief port valve after the relief port valve reaches the stop causes the relief port valve to open the relief port. Preferably, a spring urges the relief port valve toward a closed position.

In the embodiment shown, the relief valve comprises a valve sleeve mounted around a body of the piston sub assembly, the valve sleeve having a closed position blocking the relief port and an open position opening the relief port. The valve sleeve is in the closed position and movable in unison with the body of the piston sub assembly during the down stroke and during the up stroke until the piston sub assembly nears the top of the stroke, at which point, the body of the piston sub assembly moves upward relative to the valve sleeve, causing the valve sleeve to move to the open position. A spring urges the valve sleeve toward the closed position.

In the example shown, a downward facing relief valve stop shoulder is located in the barrel below the standing valve. A retainer on the body of the piston sub assembly limits upward movement of the valve sleeve relative to the body of the piston sub assembly.

Preferably, an electric motor having a rotatable drive shaft is coupled to a linear actuator for converting rotational motion of the drive shaft to reciprocating motion of the piston sub assembly.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1A:
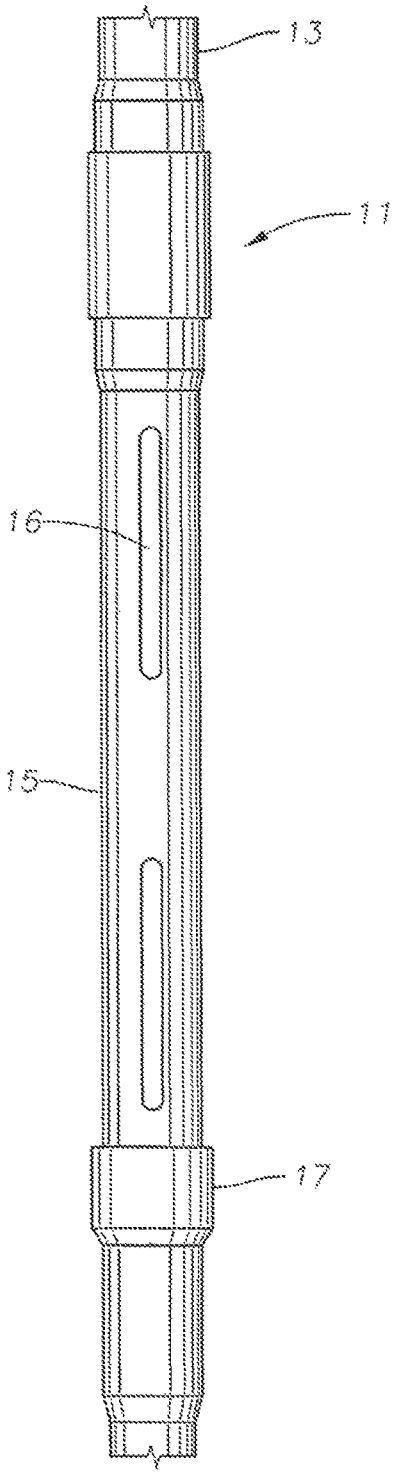
FIGS. 1A and 1B comprise a side view of a pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1A, a well pump assembly 11 is illustrated suspended on a string of production tubing 13. In this example, well pump assembly 11 includes a tubular sub 15 with inlet ports 16. Sub 15 secures by threads to the lower end of production tubing 13. Pump assembly 11 may be used in inclined and horizontal wells, thus the terms "upper" and "lower" are used only for convenience and not in a limiting manner. A tubular landing receptacle 17 secures to the lower end of sub 15.

Figure 1B:
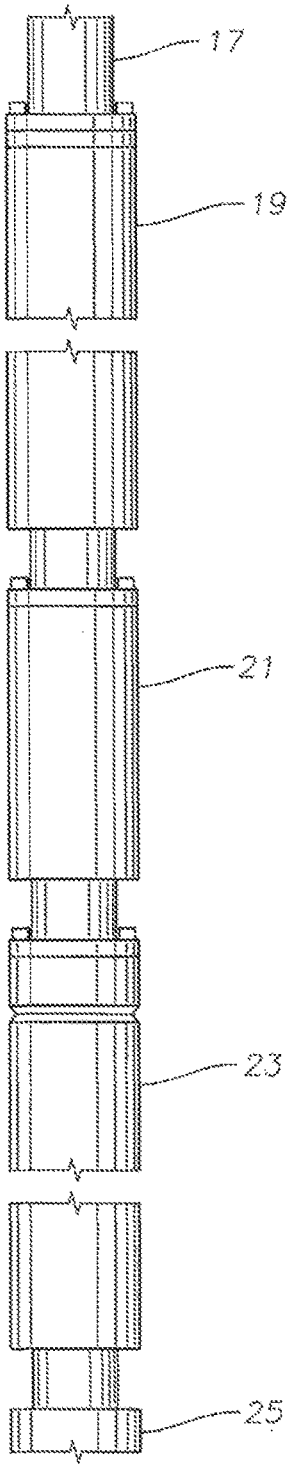

Referring to FIG. 1B, landing receptacle 17 secures to the upper end of a seal or pressure equalizing section 19. A gear reducer 21 secures to the lower end of seal section 19 in this embodiment. An electrical motor 23 secures to the lower end of gear reducer 21. A sensing unit 25 optionally may be attached to the low end of motor 23 to provide readings of pressure, temperature, and other parameters. A power cable (not shown) will extend alongside tubing 13 from a wellhead at the top of the well to provide power to motor 23. Seal section 19 reduces a pressure difference between dielectric lubricant in motor 23 and the hydrostatic pressure of the well fluid.

Figure 2A:
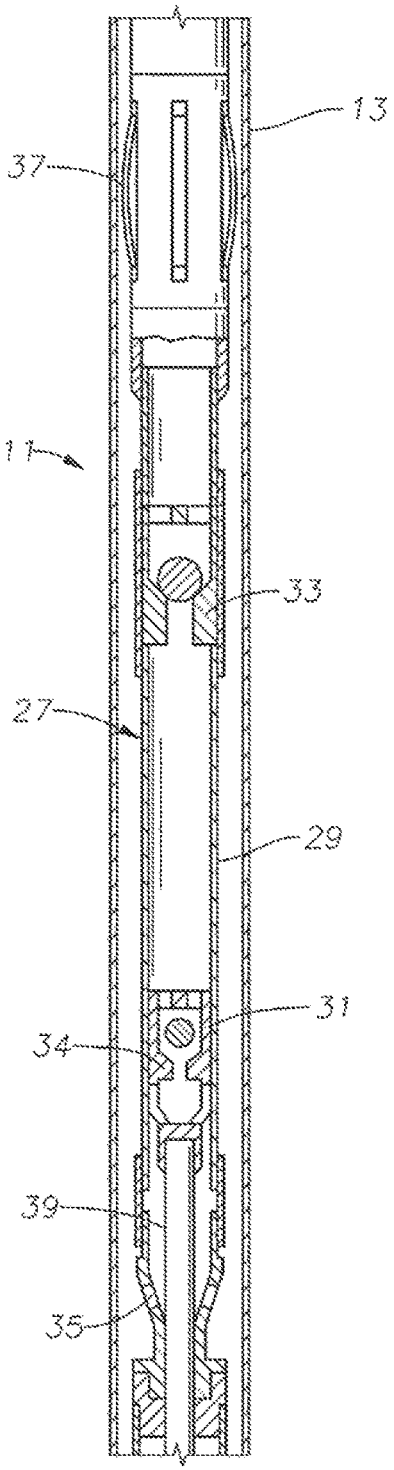
FIGS. 2A and 2B comprise a sectional view of part of the pump assembly of FIGS. 1A and 1B.

Referring to FIG. 2A, pump 27 has a barrel 29, a travelling valve 31, a standing valve 33, and a piston 34, all of which are shown schematically. Standing valve 33 secures to the upper end of barrel 29, and travelling valve 31 and piston 34 are part of a piston sub assembly that move axially within barrel 29 between an up stroke and a down stroke. Piston 34 slides sealingly on the inner diameter of barrel 29 to push fluid upward during an upstroke. An intake 35 located in barrel 29 below piston 34 admits well fluid through travelling valve 31 into barrel 29. During the down stroke, the well fluid flows through travelling valve 31 as travelling valve 31 moves downward. During the down stroke, standing valve 33 is closed, preventing well fluid in production tubing 13 from flowing downward past standing valve 33. During the up stroke, travelling valve 31 closes, causing the upward movement of piston 34 to push the well fluid above piston 34 upward through standing valve 33, thereby lifting the column of well fluid in production tubing 13 an increment. At the top of the stroke, standing valve 33 closes.

Figure 2B:
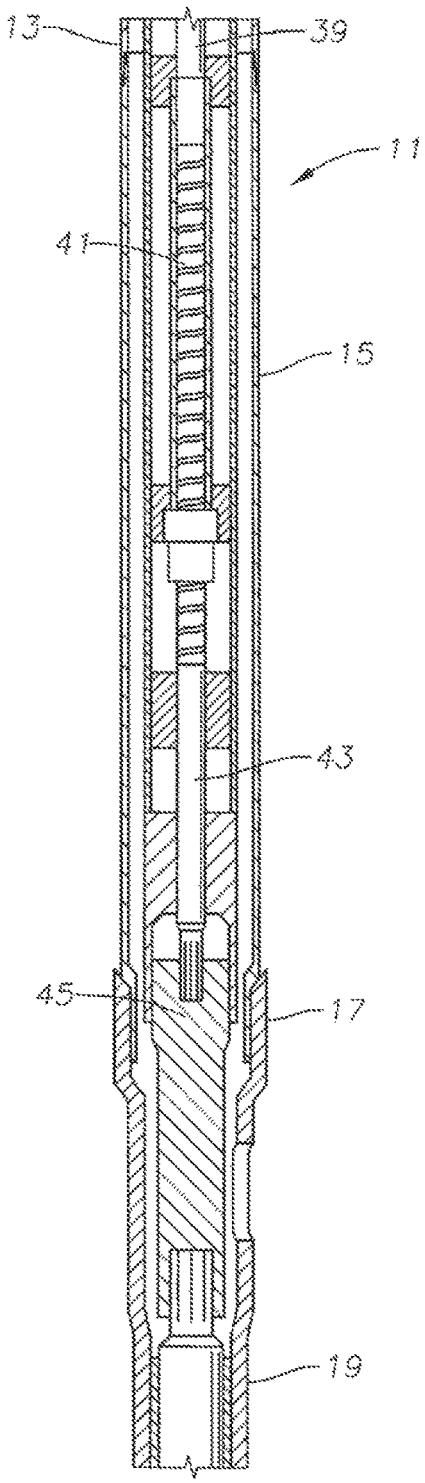

In this embodiment, a landing collar 37 on the upper end of pump 27 fictionally engages the interior of production tubing 13 to resist movement of pump 27 once installed within tubing 13. A reciprocating rod 39 strokes piston 34. Referring to FIG. 2B, in this example, a reversing linear actuator 41 reciprocates rod 39. Linear actuator 41 is a ball screw mechanism that is engaged on its lower end by a rotating drive shaft 43, which is rotated by motor 23. Linear actuator 41 transforms the rotating movement of drive shaft 43 into reciprocating movement of rod 39. Drive shaft 43 has a set of helical grooves on which a ball element, which is restrained from rotation, moves linearly. The ball element is linked to reciprocating rod 39 that connects with piston 34. Other mechanisms to stroke pump 27 are feasible.

In this example, motor 23, gear reducer 21, and seal section 19 are secured to landing receptacle 17, which in turn is secured to production tubing 13; thus these components are installed when production tubing 13 is run. Pump 27, linear actuator 41, and drive shaft 43, are run through production tubing 13 after production tubing 13 has been installed. A stabbing guide 45 on the lower end of drive shaft 43 stabs into the drive shaft of motor 23 within landing receptacle 17.

Figure 3:
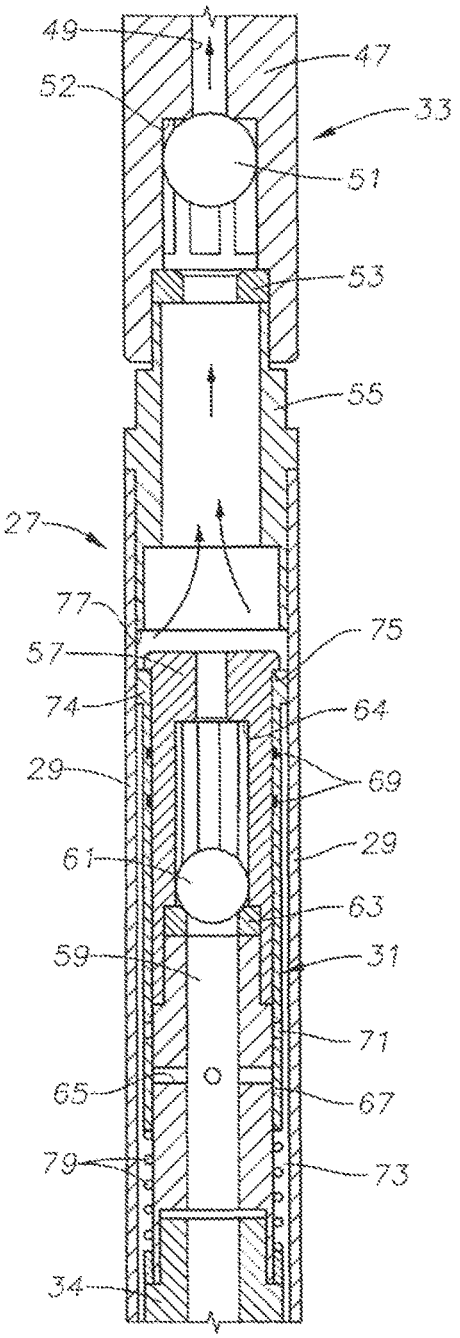
FIG. 3 is a sectional view of the pump of the pump assembly of FIGS. 1A and 1B, shown during the upstroke.

Referring to FIG. 3, which is a more detailed view of pump 27, standing valve 33 has a standing valve cage or housing 47 with an axial flow passage 49 extending through it. A valve element, which is normally a ball 51, is carried within an enlarged lower portion of flow passage 49. Ball 51 is axially movable between a downward facing shoulder 52 in flow passage 49 and a seat 53. When ball 51 is located on seat 53, it blocks downward flow of well fluid in flow passage 49. However, ball 51 does not block upward flowing well fluid while it is in the upper position shown in FIG. 3 in contact with shoulder 52. Standing valve housing 47 secures by threads to a connector 55, which secures to barrel 29. Standing valve housing 47 and connector 55 may be considered to be a part of barrel 29.

Travelling valve 31 has a tubular body 57 with an axial bore 59. A valve element, typically a ball 61, locates within an enlarged lower portion of bore 59. Ball 61 moves between a lower position on a seat 63 and an upper position in contact with a downward facing shoulder 64 in bore 59. While in the lower position shown in FIG. 3, ball 61 blocks downward flow of well fluid through bore 59. While in the upper position, ball 61 will not block upward flowing in bore 59. Travelling valve body 57 has a relief port 65 extending radially from bore 59 to the exterior of body 57. Travelling valve body 57 secures by threads to the upper end of piston 34, which slides within barrel 29, forming a sealing engagement. Bore 59 also extends through piston 34. Travelling valve 31 and piston 34 form a piston sub assembly.

A valve sleeve 67 fits closely around travel bag valve body 57. Valve sleeve 67 may have seals 69 to seal the inner diameter of valve sleeve 67 to the outer diameter of travelling valve body 57. Valve sleeve 67 has a relief port 71 extending from its inner diameter to its outer diameter. Valve sleeve 67 is axially movable on travelling valve body 57.

Figure 5:
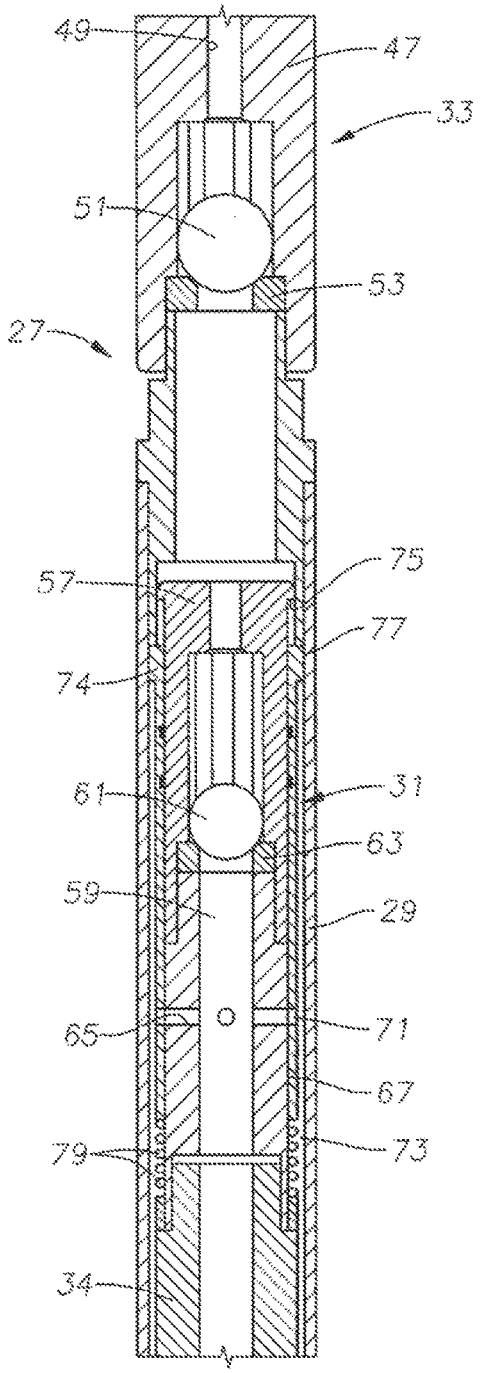
FIG. 5 is a sectional view of the pump of FIG. 3 at the top of the up stroke and illustrating the sliding pressure relief valve sleeve relieving pressure acting upward on the upper ball.

When valve sleeve relief port 71 is misaligned with body relief port 65, as shown in FIG. 3, valve sleeve 67 blocks any flow through body relief port 65. When aligned, as shown in FIG. 5, flow through body relief port 65 and valve sleeve relief port 71 occurs.

A valve sleeve annulus 73 is defined between the outer diameter of valve sleeve 67 and the inner diameter of barrel 29. Valve sleeve 67 has an external flange or rim 74 on its upper end that slidingly engages the inner diameter of barrel 29, but it does not seal annulus 73. Travelling valve body 57 has an external lip 75 on its upper end that extends radially outward over an inner portion of valve sleeve rim 74, limiting any further upward movement of valve sleeve 67 on body 57.

Connector 55 has a downward facing shoulder or stop 77 within barrel 29. The inner diameter of stop 77 is greater than the outer diameter of travelling valve body lip 75. As travelling valve body 57 and valve sleeve 67 move upward in unison, lip 75 will move into the inner diameter of stop 77 past stop 77, but valve sleeve rim 74 will abut stop 77. Travelling valve body 57 continues to move upward at that point while valve sleeve 67 remains stationary. A spring 79 at the lower end of valve sleeve 67 urges valve sleeve 67 toward the upper position with rim 74 bearing against lip 75. Spring 79 is illustrated as a coil spring having a lower end on an upward facing shoulder of piston 34.

In operation, motor 23 rotates stab 45, which in turn causes linear actuator 43 (FIG. 2B) to rotate. The rotation of linear actuator shaft 43 causes the linear actuator ball nut to move reciprocating rod 39 upward. Daring this upstroke movement of FIG. 3, travelling valve ball 61 is in the closed position and standing valve ball 51 in the open position. Upward movement of piston 34 pushes well fluid located above piston 34 past standing valve ball 51 into passage 49, lifting the column of well fluid in production tubing 13. Valve sleeve 67 will be moving in unison with travelling valve body 57 at this point. Relief ports 65, 71 are misaligned, blocking any fluid communication between annulus 73 and bore 59. At this point, the pressure in annulus 73 is substantially the same as in standing valve flow passage 49, which is higher than the pressure in travelling valve bore 59 below seat 63. That lower pressure below seat 63 would be approximately the hydrostatic well fluid pressure at pump intake 35 (FIG. 2A), which may be referred to as a bottom hole pressure.

Figure 4:
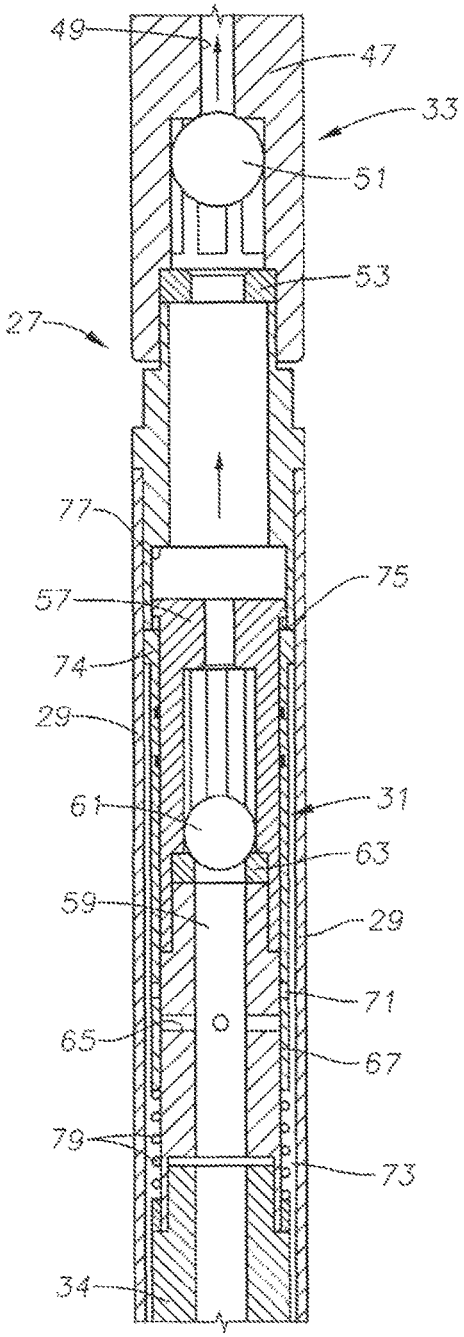
FIG. 4 is a sectional view of the pump of FIG. 3 near the top of the up stroke and with a sliding pressure relief valve sleeve contacting a stop.

Referring to FIG. 4, valve sleeve rim 74 contacts stop 77 as travelling valve 31 approaches the top of the stroke. Travelling valve body 57 continues upward movement, as illustrated in FIG. 5, while valve sleeve 67 remains stationary. At or near the top of the stroke, shown in FIG. 5, travelling valve body relief ports 65 align with valve sleeve relief ports 71. The alignment establishes fluid communication between annulus 73 and travelling valve body bore 59 below seat 63. The higher pressure well fluid in barrel 29 between standing valve ball 51 and piston 34 flows from annulus 73 through relief ports 65, 71 into bore 59, thus reducing the higher pressure in barrel 29 that might otherwise tend to keep standing valve ball 51 above its seat 53. Standing valve ball 51 is thus free to drop by gravity onto seat 53, which blocks downward flow of well fluid in flow passage 49. A dwell exists while piston 34 changes from upward movement to downward movements, and during the dwell, the alignment of relief ports 65, 71 prevents standing valve ball 51 from stalling in the upper unseated position.

Figure 6:
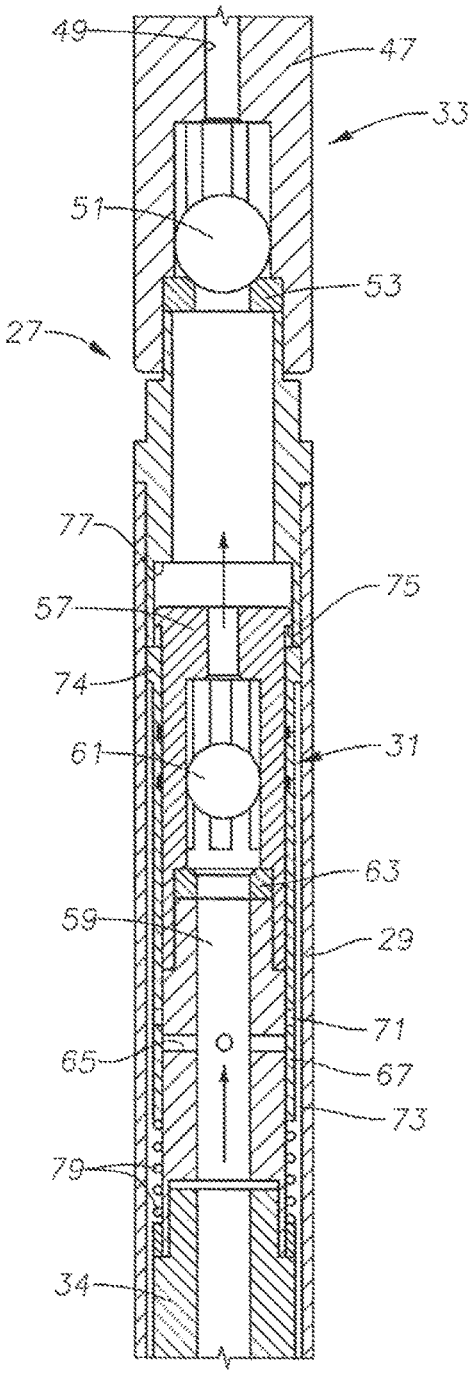
FIG. 6 is a sectional view of the pump of FIG. 3 at the commencement of the down stroke.

FIG. 6 illustrates a post dwell position, with piston 34 moving downward relative to valve sleeve 67 as a result of the ball nut of linear actuator 41 (FIG. 2B) beginning to move downward on the linear actuator shaft. Spring 79 initially keeps valve sleeve rim 74 in abutment with stop 77. Relief ports 65, 71 again become misaligned, blocking any further fluid communication between annulus 73 and bore 59. As piston 34 moves downward, well fluid flows into the lower end of bore 59 and past travelling valve ball 61, which is now open. Well fluid within bore 59 and above piston 34 will be at the lower bottom hole pressure. The pressure on the upper side of closed standing valve ball 51 will be equal to hydrostatic pressure of the column of well fluid in production tubing 13, much higher than the bottom hole pressure.

Figure 7:
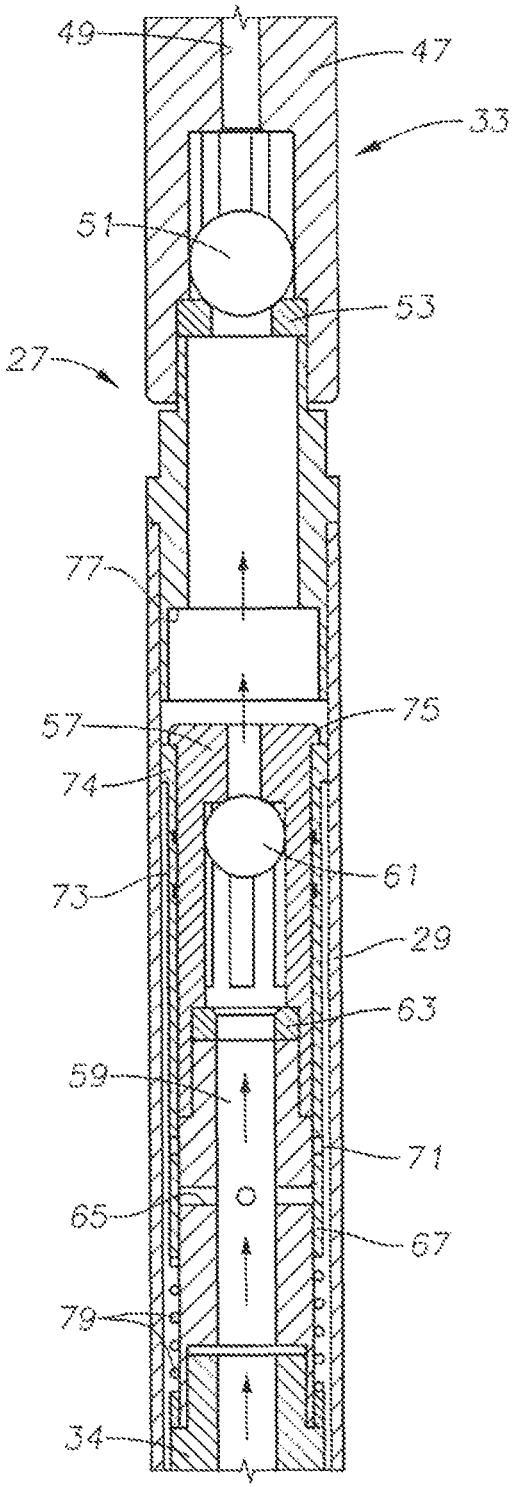
FIG. 7 is a sectional view of the pump of FIG. 3 during the down stroke.

The down stroke continues, as shown in FIG. 7, causing lip 75 to engage valve sleeve rim 74, which disengages from stop 77. Valve sleeve 67 then moves downward in unison with travelling valve body 57. At the bottom of the stroke, which is not shown, travelling valve ball 61 closes. Then upward movement of piston 34 causes well fluid to open standing valve ball 51, as shown in FIG. 3.

While the disclosure has been described in only a few of its forms, it should be apparent to those skilled in the art that various changes may be made. For example, the standing and travelling valves may have a variety of configurations.

The invention claimed is:

1. A reciprocating well pump assembly, comprising:

a barrel having an axis;

a piston sub assembly reciprocally and slidably carried within the barrel between up stroke and down stroke positions, the piston sub assembly having a bore for receiving well fluid from a well during the down stroke;

a travelling valve element in the piston sub assembly that moves between an open position allowing the well fluid to flow up the bore into the barrel above the piston sub assembly during the down stroke to a closed position during the up stroke for lifting the well fluid located in the barrel above the piston sub assembly;

a standing valve at an upper end of the barrel that is movable between an open position during the up stroke of the piston sub assembly and a closed position during the down stroke of the piston sub assembly;

a relief port extending from the bore of the piston sub assembly into the barrel; and a relief port valve that closes the relief port during the down stroke and part of the up stroke, and which opens the relief port as the piston sub assembly nears a top of the up stroke, to reduce fluid pressure in the barrel above the piston sub assembly and allow the standing valve to move to the closed position at the top of the up stroke.

2. The well pump assembly according to claim 1, wherein the relief port extends from the bore to an annulus located between the piston sub assembly and the barrel.

3. The well pump assembly according to claim 1, wherein:

the piston sub assembly has a piston that slidably engages the bore; and the relief port extends from the bore to an annulus in the barrel surrounding the travelling valve element above the piston.

4. The well pump assembly according to claim 1, further comprising:

a stop located in the barrel below the standing valve; and wherein the relief port valve engages the stop as the piston sub assembly nears the top of the up stroke to cause the relief port to open.

5. The well pump assembly according to claim 1, further comprising:

a stop in the barrel below the standing valve; wherein the relief port valve moves in unison with the piston sub assembly during the up stroke until reaching the stop; and continued upward movement of the piston sub assembly relative to the relief port valve after the relief port valve reaches the stop causes the relief port valve to open the relief port.

6. The well pump assembly according to claim 1, further comprising:

a spring that urges the relief port valve toward a closed position.

7. The well pump assembly according to claim 1, wherein the relief valve comprises:

a valve sleeve mounted around a body of the piston sub assembly, the valve sleeve having a closed position blocking the relief port and an open position opening the relief port;

the valve sleeve being in the closed position and movable in unison with the body of the piston sub assembly during the down stroke and during the up stroke until the piston sub assembly nears the top of the up stroke, at which point, the body of the piston sub assembly moves upward relative to the valve sleeve, causing the valve sleeve to move to the open position; and a spring urging the valve sleeve toward the closed position.

8. The well pump assembly according to claim 1, further comprising:

a downward facing relief valve stop shoulder in the barrel below the standing valve; and wherein the relief valve comprises:

a valve sleeve mounted around a body of the piston sub assembly, the valve sleeve having a closed position blocking the relief port and an open position opening the relief port;

the valve sleeve being in the closed position and movable in unison with the body of the piston sub assembly during the down stroke and during the up stroke until the valve sleeve contacts the valve sleeve stop shoulder, at which point, the body of the piston sub assembly moves upward relative to the valve sleeve past the valve sleeve stop shoulder, causing the valve sleeve to move to the open position;

a spring urging the valve sleeve upward on the body of the piston sub assembly toward the closed position; and a retainer on the body of the piston sub assembly that limits upward movement of the valve sleeve relative to the body of the piston sub assembly.

9. The well pump assembly according to claim 1, further comprising:

an electric motor that rotates a drive shaft;

a linear actuator operatively coupled between the motor and the piston sub assembly for converting rotational motion of the drive shaft to reciprocating motion of the piston sub assembly.

10. A reciprocating well pump assembly, comprising:

a barrel having an axis;

a piston reciprocally carried within the barrel between up stroke and down stroke positions;

a travelling valve mounted to the piston for movement in unison, the travelling valve having a tubular body with a bore and a travelling valve element within the bore that is movable relative to the tubular body between a closed position during the up stroke of the travelling valve and an open position during the down stroke of the travelling valve;

a tubular body relief port extending from the bore through a side wall of the tubular body;

a standing valve at an upper end of the barrel that is movable between an open position during the up stroke of the travelling valve and a closed position during the down stroke of the travelling valve, the standing valve being in fluid communication with the bore of the body of the travelling valve for receiving well fluid lifted by the piston during the upstroke;

a valve sleeve mounted around the tubular body, defining a valve sleeve annulus between the barrel and the valve sleeve, the valve sleeve being axially movable relative to the tubular body between a closed position, closing the tubular body relief port, and an open position, communicating well fluid in the valve sleeve annulus with the well fluid in the bore;

a spring urging the valve sleeve toward the closed position;

a stop in the barrel positioned for contact by the valve sleeve a selected distance from a top of the up stroke, enabling the tubular body to continue movement toward the top of the up stroke relative to the valve sleeve and placing the valve sleeve in the open position;

an electric motor located below the barrel; and a linear actuator between the motor and the piston for stroking the piston in response to rotational motion of the motor.

11. The well pump assembly according to claim 10, wherein the valve sleeve annulus is located above the piston.

12. The well pump assembly according to claim 10, further comprising:

a lip on an upper end of the tubular body; and wherein the spring urges an upper end of the valve sleeve against the lip.

13. The well pump assembly according to claim 10, wherein the well pump assembly further comprises:

an annular lip on an upper end of the tubular body, the spring urging an upper end of the valve sleeve against the lip; wherein the stop comprises a downward facing shoulder; and during the upstroke, the lip moves upward past the downward facing shoulder after the upper end of the valve sleeve contacts the downward facing shoulder.

14. The well pump assembly according to claim 10, wherein the relief port is located below the travelling valve.

15. The well pump assembly according to claim 10, wherein:

the valve sleeve has a valve sleeve relief port that registers with the tubular body relief port while the valve sleeve is in the open position, and which is misaligned with the tubular body relief portion while the valve sleeve is in the closed position.

16. A method of pumping well fluid from a well with a reciprocating well pump assembly having a barrel, a piston sub assembly carried in the barrel and having a bore, a travelling valve element in the piston sub assembly, and a standing valve element in the barrel, the method comprising:

providing a relief port extending from the bore of the piston sub assembly and a relief port valve;

lowering the piston sub assembly in the barrel while the relief port valve and the standing valve element are closed, causing well fluid in the well to enter the bore and opening the travelling valve to admit the well fluid into the barrel above the piston;

moving the piston sub assembly upward in the barrel while the travelling valve and relief port valve are closed, causing the standing valve element to open and the piston sub assembly to lift the well fluid in the barrel upward past the standing valve element; then prior to reaching a top of the stroke, opening the relief port valve, causing the well fluid in the barrel to flow through the relief port into the bore and allowing the standing valve element to close.

17. The method according to claim 16, wherein opening the relief port valve comprises engaging the relief port valve with a stop provided in the barrel, and continuing to move the piston sub assembly upward relative to the relief valve toward the top of the stroke.

18. The method according to claim 16, further comprising urging the relief port valve to a closed position.

19. The method according to claim 16, wherein:

during the upstroke while the relief port valve is closed, a fluid pressure of the well fluid in the bore below the travelling valve will be less than a fluid pressure of the well fluid in the barrel above the travelling valve; and opening the relief port valve lowers the fluid pressure of the well fluid in the barrel above the travelling valve.

20. The method according to claim 16, wherein moving the piston sub assembly upward comprises:

operating an electric motor to rotate a drive shaft; and converting rotation of the drive shaft into linear movement of the piston sub assembly.

* * * * *